United States Patent [19]

Saringer

[11] Patent Number: 4,665,900

[45] **Date of Patent: * May 19, 1987**

[54] DEVICE FOR IMPARTING CONTINUOUS PASSIVE MOTION TO HUMAN JOINTS

[75] Inventor: John H. Saringer, Toronto, Canada

[73] Assignee: Toronto Medical Corp., Scarborough, Canada

[ * ] Notice: The portion of the term of this patent subsequent to Dec. 11, 2001 has been disclaimed.

[21] Appl. No.: 688,162

[22] Filed: Dec. 31, 1984

Related U.S. Application Data

[60] Continuation-in-part of Ser. No. 660,704, Oct. 15, 1984, Pat. No. 4,537,083, which is a division of Ser. No. 362,896, Mar. 29, 1982, Pat. No. 4,487,199.

[51] Int. Cl.[4] ..... A61H 1/00

[52] U.S. Cl. ..... 128/26; 128/25 R

[58] Field of Search ..... 128/25 R, 25 B, 26, 128/52; 272/67

[56] References Cited

U.S. PATENT DOCUMENTS

| | | | |
|---|---|---|---|
| 2,353,129 | 7/1944 | DeMona | 128/26 |
| 3,457,912 | 7/1969 | Clark et al. | 128/26 |
| 3,756,222 | 9/1973 | Ketchum | 128/26 |
| 4,487,199 | 12/1984 | Saringer | 128/25 R |

FOREIGN PATENT DOCUMENTS

| | | | |
|---|---|---|---|
| 1438402 | 2/1967 | France | 128/26 |

*Primary Examiner*—Richard J. Apley
*Assistant Examiner*—J. Welsh
*Attorney, Agent, or Firm*—Bachman & LaPointe

[57] ABSTRACT

An apparatus for applying continuous passive motion to the joints of several fingers of the hand at the same time. It includes a support housing for mounting it on the forearm, carrying a motor and a traveller movable by a motor through an elongated path in a reciprocating movement. A connecting rod connects the traveller to a manifold block which, in turn, has elements connected to several fingers whereby their joints are mobilized simultaneously.

7 Claims, 7 Drawing Figures

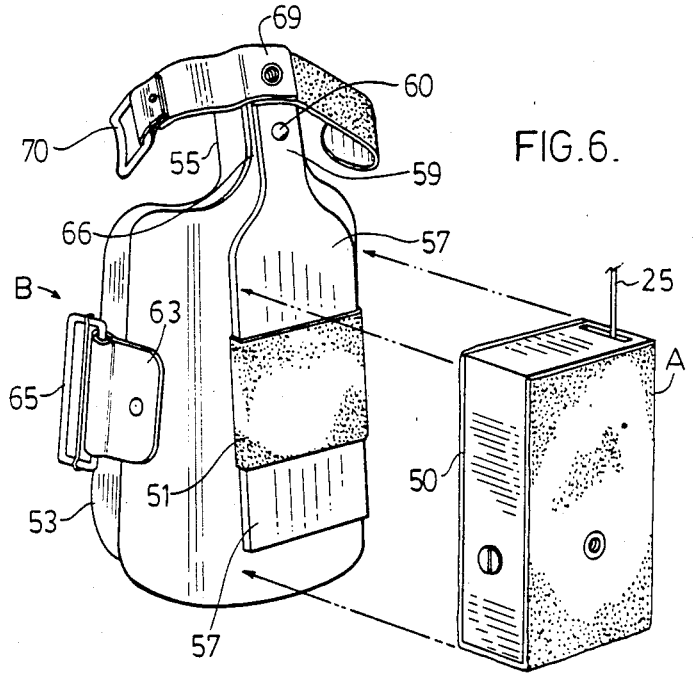
FIG. 6.
FIG. 7.
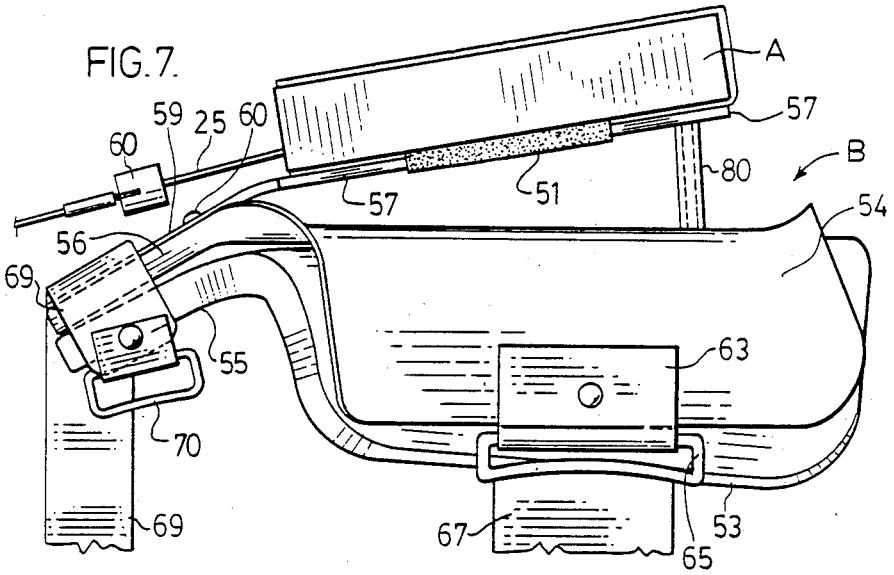

DEVICE FOR IMPARTING CONTINUOUS PASSIVE MOTION TO HUMAN JOINTS

This application is a continuation-in-part of application Ser. No. 660,704, filed Oct. 15, 1984 now U.S. Pat. No. 4,537,083 which is a division of Ser. No. 362,896, filed Mar. 29, 1982, now U.S. Pat. No. 4,487,199.

BACKGROUND OF THE INVENTION

1. Field of the Invention

This invention relates to a portable prosthetic device used to treat a human joint by applying "continuous passive motion".

2. Description of the Prior Art

Dr. Robert B. Salter, Professor and Head of Orthopaedic Surgery at the University of Toronto, and Senior Orthopaedic Surgeon at the Hospital for Sick Children in Toronto, first developed the concept and coined the expression "continuous passive motion". Dr. Salter's work is described in the article "Joints Were Meant to Move—And Move Again" by Ohlendorf in "The Graduate", published by The Department of Information Services, University of Toronto, September/October 1980.

Briefly, according to this concept, a human joint, for example, a knee, elbow, or finger joint, is kept under slow continuous constrained motion as distinct from being held motionless or being moved intermittently. Keeping an injured or post operative joint mobile rather than immobilizing it in a cast is beneficial to the cartilage.

Attempts which have been made to provide machines that exercise joints are designed for intermittent operation and do not supply continuous passive motion. Moreover, they are usually too heavy and bulky to be readily portable and thus to be mounted on the body.

A primary aim of the present invention is to provide an apparatus which imparts continuous motion to the joint and which is portable so that it can be mounted on the patient's body.

SUMMARY OF THE INVENTION

Application No. 362,896 covers an apparatus for imparting continuous passive motion to a human joint. It comprises a support and linked thereto first connecting means for connection to a part of the body at one side of a joint to be mobilized, traveller means movable in a linear path relative to the support, provided with second connecting means for connection to a part of the body at the other side of the joint to be mobilized. In this way, the joint forms a movable link which is flexed as the travelling means moves back and forth relative to the support. Motor drive means is provided, for imparting, to the traveller means, substantially continuous slow rhythmic reciprocating movement. And, there is means for reversing the motor drive means at any point in its path to continue the reciprocating movement. More specific structure is also described and claimed.

The present application is directed to a portable continuous passive motion apparatus along these lines, specifically constructed for mobilizing at least one digit, and preferably several digits, of the hand. This apparatus comprises mounting means for firm connection to the forearm. A support is connectable to the mounting means and supports an actuator for producing continuous linear reciprocating movement. An elongating connecting member links the actuator with a distal part of one or more hand digits whereby the joints of the digit are continuously mobilized. In a preferred structure the actuator means includes a motor, an endless train driven thereby through an elongated circuit. The elongating connecting member is connected to the chain to travel therewith throughout its circuit, producing the back and forth movements which are transmitted to the hand digit. For mobilizing several digits at the same time, a structure is provided which has a central connecting rod connected at one end to the travelling means extending from the support to a connection with a manifold block. From the manifold block there extends several connecting rods each connected flexibly to the distal end of a digit. One suitable form of connection is a clevis which is mounted on the end of a connecting rod, with the other end pivotally mounted to a plate held to the distal part of the digit. In a preferred construction, the plate has a flat part resting against the surface of the digit and a lug extending from it for connection to the clevis. An adhesive strip maintains the plate against the surface of the digit and is provided with a slot through which the lug extends to its connection with the clevis.

BRIEF DESCRIPTION OF THE DRAWINGS

Having thus generally described the invention, it will be referred to more specifically by reference to the accompanying drawings which illustrate a preferred embodiment and in which:

FIG. 6 is an exploded perspective view looking at the top of the harness and showing the interlocking fabric connecting it to the supporting housing; and FIG. 7 is a side elevation, enlarged in comparison with Figure illustrating particularly the construction of a preferred harness on the arm and its relationship to the drive housing.

DESCRIPTION OF THE PREFERRED EMBODIMENTS

Figure 1:
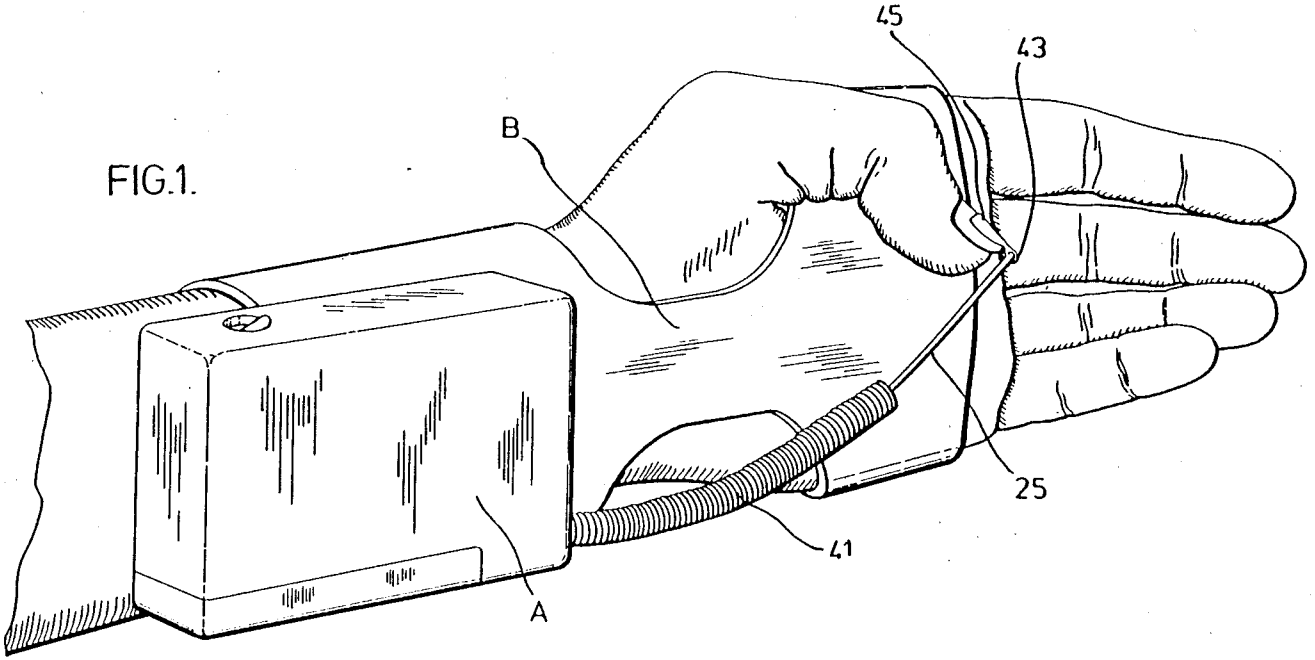
FIG. 1 is a perspective view illustrating one form of unit for mobilizing a hand digit joint including a harness mountable on the forearm and hand and a housing mountable on the harness and an actuating rod extending from the housing to the hand digit, in this case the thumb.

Referring more particularly to the drawings, a drive housing A is carried by a mounting arrangement or harness indicated generally by B, which is supported by the forearm and wrist.

The support housing A is connected to the cuff B and an actuator wire 25 moves back and forth on the housing A through a flexible guide tube 41 to a connection with the thumb.

The connection from the actuator wire 25 to the thumb is through a hinge 43 to a small plate 45 adhesively connected to the thumbnail. Alternatively, the actuator 45 may be connected to any of the fingers or several fingers at the same time.

Figure 2:
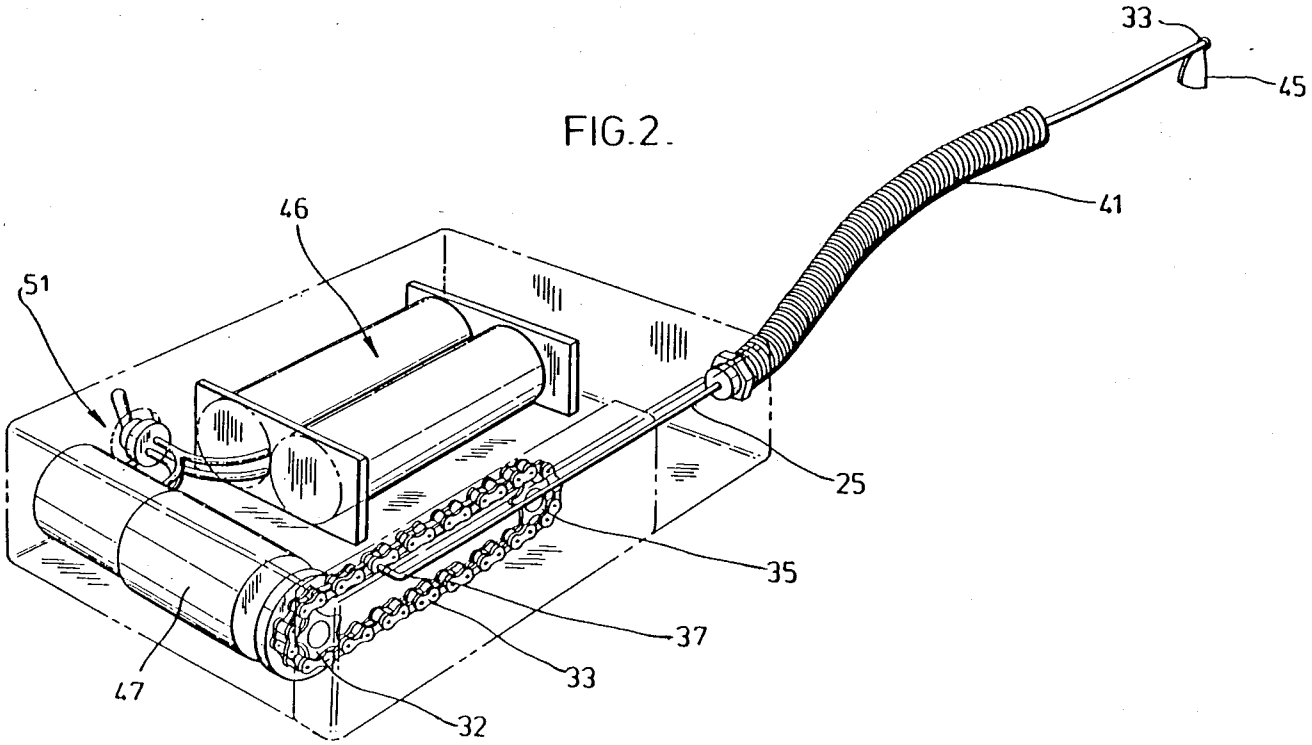
FIG. 2 is a perspective view showing the mechanism inside the housing of FIG. 1 with the housing removed and is position shown in dotted lines.
Figure 3:
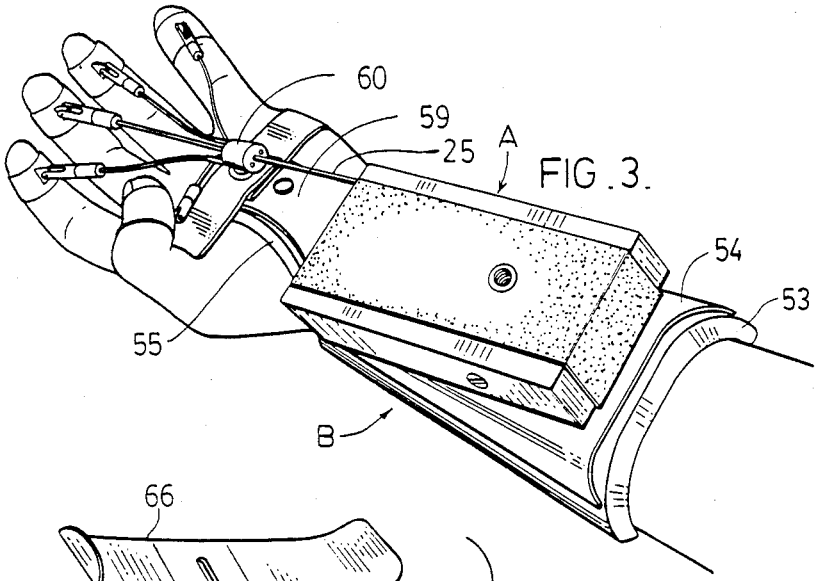
FIG. 3 is a perspective view of an apparatus for mobilzing the joints of several different hand digits at the same time and in which the harness and casing are modified over those shown in FIGS. 1 and 2.
Figure 4:
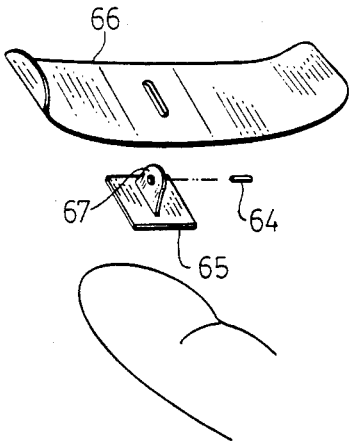
FIG. 4 is an exploded perspective view showing particularly the plate for mounting on the distal part of the hand digit and the adhesive strip used for connecting it.
Figure 5:
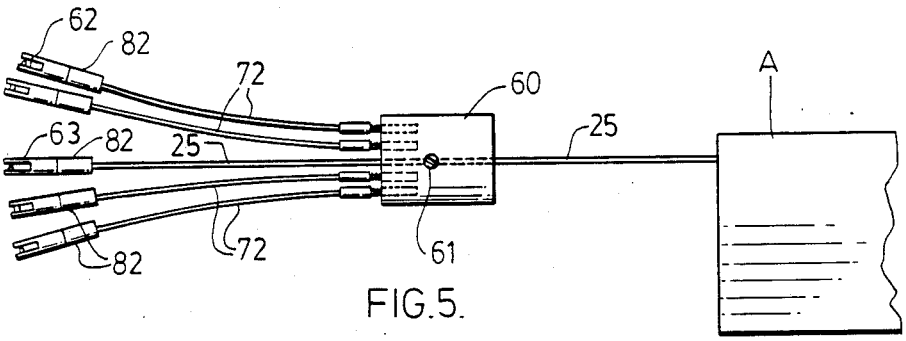
FIG. 5 is a fragmentary plan view on an enlarged scale showing the several connecting rods leading to the hand digit.

The mechanism for moving the actuator wire 25 is shown in FIG. 2. The support structure is fashioned from a block of plastic in which recesses have been made to accommodate the various parts. A geared motor 47 drives a sprocket 32 about which there is trained a chain 33 which is also trained about a spaced-apart sprocket 43. The actuator wire 25 is connected at 37 to one of the links of the chain 33. Batteries 46 are accommodated within the block as is an operating switch 51. The motor moves the chain continuously so that the actuator wire 25 moves in one direction along the top run of the chain and then down along the bottom run in the other direction so as to impart substantially continuous reciprocating movement to the wire 25 and consequently to the hand joint.

FIGS. 3 through 7 show an alternative form of device, as compared with that of FIGS. 1 and 2.

The mounting arrangement includes an extensive foam pad 53, which engages the surface of the forearm and wrist. The pad 53 narrows to a neck part 55 which extends over the palm of the hand. For mounting the pad 53 is a saddle 54, of relatively rigid thin plastic, which also narrows to a neck 56 which overlies the neck 55.

Mounted above the saddle 54 is a plate 57, which narrows to a neck 59 which is held to the necks 55 and 56 by a rivet 60.

At its opposite or rear-end, the plate 57 is spaced from the saddle 54 by a prop 80, which in the form shown is a tube having one end screwed to the plate 57 and having the other screwed to the saddle 59.

A fabric anchoring loop 63 is riveted to the margin of the saddle 54 midway along its length and carries a metal eye 65 to receive a belt, for surrounding the forearm, which extends through an adjustable buckle anchored to the other side of the saddle 54.

A belt 69, to surround the hand, is riveted to the assembly of necks 55, 56 and 59. The belt 69 is provided at one end with a buckle 70. The belt 69 encircles the hand just in front of the root of the thumb.

By this arrangement, the plate 57 is supported from the forearm with its forepart strapped relatively firmly to the palm of the hand and its rear part held relatively firmly to the forearm. The plate is thus fully supported from the forearm in a position for mounting the housing A.

To this end, the plate 57 carries a pad 51 of the well known VELCRO (trade mark) fabric having a pile surface made up of a mass of small loops to engage a complementary pad 50 on the undersurface of the drive housing A, having the VELCRO fabric surface made up of a mass of hooks which anchor themselves to the loops of the pad 51. The VELCRO anchorage of the pad 50 to the pad 51 is adequate to hold the housing in place in normal usage. But, the pads 50 and 51 may readily be peeled apart by pulling hard enough, for removal of the housing A from the mounting arrangement B.

In accordance with this form of the invention, an actuator wire extends from reciprocating mechanism inside the housing A (as illustrated in FIG. 2). There is slidably mounted on the actuator wire 25 a cylindrical manifold block or yoke 60, the block 60 having an axial opening through it to accommodate the wire 25. There is a set screw 61 operating in a transverse tapped opening in the block 60 to engage the wire 25 and maintain it in position.

The end of the wire 25 carries a clevis 82 provided with a tapped opening receiving the threaded end of the wire 25. The clevis has a slot 62 dividing its end into fingers 63 through which there extends a pin 64 to engage a connecting pin and finger connector, as will be described.

The connector includes a plate 65*a* which rests against the surface of the distal part of the finger and is held to it by an adhesive strip surrounding the finger. A perforated lug 67 extends from the plate 65 through an opening 62 in the strip 66 into the slot 62 and is engaged by the pin 64. So with the strip 66 engaging the finger, the clevis is pivotally held to the distal end of the finger.

In a similar manner, the other fingers are connected to the block 60 by respective wires 72 each having a threaded inner end, engaging a tapped opening in the block 60, and a threaded outer end engaging a tapped opening in a clevis similar to the clevis 82 and held to the finger in the same way.

A preferred actuator wire 25 is of 16 gauge solid music wire. Preferred wires 72 are of stranded 16 gauge metal, e.g. steel, wire to give them more flexibility.

The operation of the device is as previously described. The drive mechanism moves the actuator wire 25 back and forth in reciprocal movement which is transmitted to the fingers through the wires 25 and 72 so that the joints of all the fingers connected to the actuator are mobilized at the same time.

Likewise, the thumb may be linked to the manifold 60 by another wire as can the little finger which is shown free in the drawing.

I claim:

1. A portable continuous passive motion apparatus for hand digit joint mobilizing, comprising, a support for firm mounting on the forearm for portable carriage thereby, an actuator mounted on the support including motor means for producing continuous linear reciprocating movements of a portion of an elongated connecting member, and, said elongated connecting member linking the actuator with the distal part of a hand digit whereby the joints of the digit are continuously mobilized.

2. An apparatus, as defined in claim 1, in which, the actuator includes a reversible motor which will reverse on the imposition of a predetermined load whereby the stroke may be reversed at any point in its path.

3. An apparatus for mobilizing the joints of a plurality of digits of the hand, comprising, a support and means for mounting the support beneath the forearm for portable carriage thereby, motor and transmission means carried by the support, travelling means movable by said transmission means through an elonagted path in reciprocating linear movements, a connecting rod connected to the travelling means and extending from the support to an end spaced therefrom, a manifold connected to the end of the connecting rod, separate means connecting the manifold to the tips of each of several digits of the hand whereby they are bent back and forth and their joints are mobilized simultaneously as the manifold is moved back and forth by the travelling means in linear strokes.

4. An apparatus, as defined in claim 3, in which the connecting means includes, a connector mounted on the distal ends of a plurality of fingers, a connecting wire extending from the manifold and having a terminal end near each of said fingers, means for linking each of said terminal ends to said connector whereby a plurality of fingers are harnessed to said block for simultaneous mobilization.

5. An apparatus, as defined in claim 1, in which the means for connecting the manifold to each digit of the hand includes a connecting rod, connected to the manifold at one end, a clevis connected to the rod at the other end, a plate held to the distal part of each digit, and a pivotal connection between the clevis and plate.

6. A portable continuous passive motion apparatus for hand digit joint mobilizing, comprising, mounting means for firm connection to the arm for portable carriage thereby, a support conectable to the mounting means, an actuator mounted on the support for producing continuous linear reciprocating movements, an elongated connecting member linking the actuator with the distal part of a hand digit whereby the joints of the digit are continuously mobilized, the actuator means including a motor and an endless chain driven thereby through an elongated circuit and the elongated connecting member connected to said chain to travel therewith throughout the circuit producing back and forth movements, in which the motor is a gear reduced DC electric motor having a drive shaft and a sprocket on the drive shaft, a shaft parallel to the drive shaft carrying an idling sprocket aligned with a drive sprocket, said chain is operatively mounted on and extends between the sprockets and is made up of a plurality of links connected by pins, the elongated connecting member being an actuator rod having one end connected to one of said links and projecting from said housing, and guide means on the housing guiding the actuator rod.

7. An apparatus, as defined in claim 6, in which the motor is a reversible motor which will reverse on the imposition of a predetermined load whereby the stroke may be reversed at any point in its path.

* * * * *